US010219064B1

(12) United States Patent
Valenzuela et al.

(10) Patent No.: US 10,219,064 B1
(45) Date of Patent: Feb. 26, 2019

(54) TRI-MICRO LOW FREQUENCY FILTER TRI-EAR BUD TIPS AND HORN BOOST WITH RATCHET EAR BUD LOCK

(71) Applicant: Acouva, Inc., San Francisco, CA (US)

(72) Inventors: Victor Manuel Valenzuela, Hayward, CA (US); Damon Vincent Mercadante, San Francisco, CA (US)

(73) Assignee: Acouva, Inc., San Francisco, CA (US)

( * ) Notice: Subject to any disclaimer, the term of this patent is extended or adjusted under 35 U.S.C. 154(b) by 0 days.

(21) Appl. No.: 15/950,122

(22) Filed: Apr. 10, 2018

(51) Int. Cl.
*H04R 25/00* (2006.01)
*H04R 1/10* (2006.01)
*G10K 11/02* (2006.01)

(52) U.S. Cl.
CPC ..... *H04R 1/1016* (2013.01); *G10K 11/025* (2013.01); *H04R 1/105* (2013.01); *H04R 1/1066* (2013.01); *H04R 25/554* (2013.01); *H04R 25/652* (2013.01); *H04R 2225/025* (2013.01); *H04R 2420/07* (2013.01); *H04R 2460/11* (2013.01)

(58) Field of Classification Search
CPC .. H04R 1/1016; H04R 1/1066; H04R 25/652; H04R 25/656; H04R 25/658; H04R 2225/023; H04R 2225/025; H04R 2460/11; A61F 11/08
USPC ..... 381/322, 324, 325, 328, 380; 181/129, 181/130, 135; 128/864
See application file for complete search history.

(56) References Cited

U.S. PATENT DOCUMENTS

| | | | | |
|---|---|---|---|---|
| 6,513,621 | B1 * | 2/2003 | Deslauriers ..... | H04R 1/1016 128/865 |
| 2006/0115105 | A1 * | 6/2006 | Brumback ..... | H04R 25/48 381/328 |
| 2011/0034218 | A1 * | 2/2011 | Sung ..... | H04R 1/2842 455/569.1 |
| 2013/0188819 | A1 * | 7/2013 | Young-Mun ..... | H04R 25/652 381/380 |
| 2014/0153762 | A1 * | 6/2014 | Shennib ..... | H04R 25/656 381/329 |
| 2016/0066110 | A1 * | 3/2016 | Shennib ..... | H04R 25/652 381/328 |

* cited by examiner

*Primary Examiner* — Huyen D Le
(74) *Attorney, Agent, or Firm* — Growth IP; Brian Lao

(57) ABSTRACT

An embodiment of the technology includes Tri-Ear Buds for a wireless in-ear utility device that provides in-ear frequency filtering and can also offer a horn that increases the wireless in-ear utility device's ability to deliver sound. The horn effect can provide higher sound levels while consuming lower battery power. The channels can provide increased safety and comfort for the user. Embodiments of the technology can include accommodation for a balance between the wearable in-ear devices and hearing aids, such as to accommodate the wearable device requiring more sealing in the ear canal for better sound quality, to accommodate the hearing aid seals requiring more leakage for allowing for the user's voice to have an increased naturalness in sound, where the balance between the both can be frequency leakage in the 50 Hz to 300 Hz, which can allow for the seal to produce high quality performance for the two platforms.

19 Claims, 10 Drawing Sheets

TRI-MICRO LOW FREQUENCY FILTER TRI-EAR BUD TIPS AND HORN BOOST WITH RATCHET EAR BUD LOCK

CROSS-REFERENCE TO RELATED APPLICATIONS

The present application is related to co-filed U.S. patent application Ser. No. 15/950,110 entitled "In-Ear Wireless Device With Bone Conduction Mic Communication," filed 10 Apr. 2018, which is incorporated in its entirety by this reference.

TECHNICAL FIELD

Embodiments of the technology relate to systems and methods for improved ear buds for use with a wireless in-ear utility device.

BACKGROUND

The following description includes information that may be useful in understanding embodiments of the technology. This description and any descriptions described herein are non-limiting and do not constitute an admission that any of the information provided herein is prior art or relevant to the presently claimed technology, or that any publication specifically or implicitly referenced is prior art.

Conventional ear pieces can be bulky and uncomfortable as well as being limited in their technological abilities. Thus, the prospects for exploring new form factors for Ear-Tips have conventionally been limited.

Therefore, a need exists for more advanced in-ear utility devices that can facilitate the comfortable wearing of in-ear utility devices for long periods of time and under a variety of conditions, especially in relation to overcoming conventional issues of extreme discomfort and potential damage to the ear drum by not allowing the sound backpressure to have other means of escaping through.

OVERVIEW

Embodiments of the technology can relate to in-ear main trunk support methods and/or systems pertaining to in-ear 8-jawratchet lock with membrane filter/retention/acoustic/frequency filter/ear breathability. More particularly, an embodiment of the technology relates to In-ear main trunk support methods and/or systems that provide Tri-Ear Buds in-ear utility devices configured to provide low frequency filtering in the range of 50 Hz to 300 Hz and assist in high quality sound performance output.

The 8-jaw ratchet lock with membrane filter, is designed for in-ear safety, for preventing the Tri-Ear Buds from coming off and getting wedged in the user's ear, the 8-jaw ratchet lock with membrane filter retention is designed to work with one jaw requiring 0.25 Lbs force to remove the Tri-Ear Buds from the in-ear utility device. In examples, by increasing the jaws to 8 can increase the removal force of the Tri-Ear Buds from removing the in-ear utility device taking up to 2.5 Lbs. in examples, the removal force can be adjusted from 0.25 Lbs/0.5 Lbs/0.75 Lbs/1.25 Lbs/1.5 Lbs/2.25 Lbs/2.5 Lbs (and/or any suitable force) by decreasing the jaws. In variations, the ratchet lock can include two levels of engagement, as a safety measure, the first engagement can be with a slight force of the Tri-ear Buds onto the in-ear utility devices. The second engagement can be by applying consistent pressure until the second detent click is felt, noted in FIG. 03 in 304 and 305.

Embodiments of the technology can include a system for improving use of an in-ear utility device, the system including Tri-Micro Low Frequency Filter Tri-Ear Bud Tips adapted for a connection to an in-ear main trunk support extending from a solid portion of the in-ear utility device, wherein the Tri-Micro Low Frequency Filter Tri-Ear Bud Tips are configured to reside in a user's ear canal within the first bend of the ear canal, wherein the Tri-Micro Low Frequency Filter Tri-Ear Bud Tips comprise an end configured to reside in the user's ear canal at a distance less than 16 millimeters from the entrance of the user's ear canal; a ratchet ear bud lock adapted to physically associate with the Tri-Micro Low Frequency Filter Tri-Ear Bud Tips to facilitate the connection between the Tri-Micro Low Frequency Filter Tri-Ear Bud Tips and the in-ear main trunk support; and/or a horn boost component adapted to physically associate with the in-ear utility device, and wherein the horn boost component is configured to facilitate an acoustic horn effect. In embodiments, the ratchet ear bud lock can include locking features configured for a removal force adjustable from at least one of 0.25 Lbs/0.5 Lbs/0.75 Lbs/1.25 Lbs/1.5 Lbs/2.25 Lbs/2.5 Lbs, by way of decreasing jaws of the locking features. In embodiments, the ratchet ear bud can include at least two levels of engagement comprising a first engagement with force of the Tri-ear Buds onto the in-ear utility devices, and a second engagement by applying consistent pressure until a detent is felt by a click feedback.

In embodiments, the horn boost component can be permanently attached to the in-ear utility device; the horn boost component can be configured to increase sound output by at least 10 dB and to facilitate improved acoustic quality; the horn boost component can be configured to improve battery life of the in-ear utility device by way of the at least 10 db sound output increase facilitated by the horn boost component; the horn boost component can comprise a detent for allowing the ratchet ear bud lock to engage and lock onto; and/or can be configured in any suitable manner.

In embodiments, the Tri-Micro Low Frequency Filter Tri-Ear Bud Tips can include a micro-filter for preventing water and debris from entering a speaker port of the in-ear utility device; the Tri-Micro Low Frequency Filter Tri-Ear Bud Tips can include an outer profile adapted to the ear canal and allowing for a uniform compression of 10% to 15% without buckling and distorting within the ear canal; the Tri-Micro Low Frequency Filter Tri-Ear Bud Tips can include micro channels configured to provide low frequency filtering in the range of 50 Hz to 300 Hz and assist in high quality sound performance output; the micro channels can be configured to provide at least two levels of micro channel filtering of the frequencies, wherein the at least two levels can facilitate the Tri-Micro Low Frequency Filter Tri-Ear Bud Tips to filter in the range of 50 Hz to 300 Hz and assist in high quality sound performance output; and/or the Ear Bud Tips can be configured in any suitable manner.

In embodiments, the ratchet ear bud lock can facilitate the connection between the Tri-Micro Low Frequency Filter Tri-Ear Bud Tips and the in-ear main trunk support by enabling the Tri-Micro Low Frequency Filter Tri-Ear Bud Tips to snap on and off at least one of the in-ear main trunk support and the solid portion; where the size of the ratchet ear bud lock fits within a cavity of the Tri-Micro Low Frequency Filter Tri-Ear Bud Tips; where the Tri-Micro Low Frequency Filter Tri-Ear Bud Tips can include at least one component constructed with medical grade bio-compatible silicone rubber; and/or can be configured in any suitable manner.

In embodiments, the system can include a wax guard physically attached to the Tri-Micro Low Frequency Filter Tri-Ear Bud Tips; and where the wax guard can include a disposable and replaceable wax guard, and wherein the wax guard is operable to improve ear health and audio output performance.

In embodiments, the system can include a housing comprising an oval shaped Horn boost with a ratchet ear bud lock configured to reside in a user's ear canal within the first bend of the ear canal, wherein the Horn boost with the ratchet ear bud lock comprises a proximal end configured to reside in the user's ear canal at a distance less than 16 millimeters from the entrance of the user's ear canal, and wherein the ratchet ear bud lock is configured to facilitate a connection between the housing and Tri-Ear Bud Tips. In embodiments, the system can further include the Tri-Ear Bud Tips, where the Tri-Ear Bud Tips can include Tri-Micro Low frequency filter Tri-Ear Bud Tips; wherein the Tri-Micro Low frequency filter Tri-Ear Bud Tips can include an oval shape cavity adapted to physically connect with an oval shaped in-ear main trunk support of the housing, by way of the ratchet ear bud lock; where a size of the ratchet ear bud lock can fit within the oval shape cavity; and/or can be configured in any suitable manner.

BRIEF DESCRIPTION OF THE FIGURES

Figures provided herein may or may not be provided to scale. The relative dimensions or proportions may vary. Embodiments of the technology may be sized to fit within an extra small to extra large ear canal of a user.

FIG. 14 additionally illustrates an example of the inclination of the wall of a horn 1403 on a Tri-Ear Buds 1401 that 1303 and 1304 has been snapped together and 1303 is bonded into 102 shown in FIG. 1, according to an embodiment of the technology.

DETAILED DESCRIPTION OF EMBODIMENTS OF THE TECHNOLOGY

Figure 1:
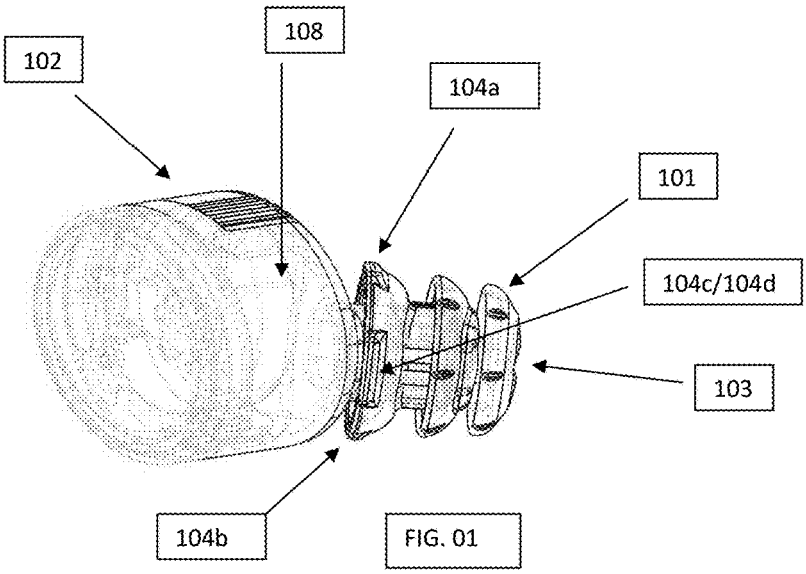
FIG. 01 illustrates an example of a wireless in-ear utility device 102 including a solid device and a Tri-Ear Buds 101, according to an embodiment of the technology.

Embodiments of the technology can include one or more improved Tri-Ear Buds for use with one or more wireless in-ear utility devices.

The improved Tri-Ear Buds can include a Frequency Filter comprising one or more filters for filtering for frequencies from low range of 50 Hz to 300 Hz. The Frequency Filter(s) can allow the Tri-Ear Buds to respond to higher sound quality performance in the user's ear when the in-ear utility device is worn, according to an embodiment of the technology.

The improved Tri-Ear Buds can also include a separate attachment that's in line with the speaker chamber port opening that has been designed to utilize the horn effect. In variations, providing the horn effect in the separate attachment of the speaker chamber port in the Tri-Ear Buds can cause a significant increase in the level of sound (by approximately 10 dB to 15 dB improvement) produced by the speaker chamber of the in-ear utility device. Increasing the level of sound using the horn effect on the separate attachment can allow the speaker chamber port of the Tri-Ear Buds to allow the wireless in-ear utility device to produce higher sound quality and thus reduce over saturated unwanted sounds and allowing for the user to hear better sound quality at lower volume, according to an embodiment of the technology. As such, embodiments of the technology can facilitate improvements to the physical hardware itself, as a well as more generally to the technical field of audiology and related fields.

Embodiments of the wireless in-ear utility device may be used for a variety of purposes and include a variety of electronic packages, such as for use as an Psap, hearing aids, for use as a music player, for use as a headphone device, and for use in various external health-monitoring applications accessories. Embodiments of the technology can include a wireless in-ear utility device configured to have a variety of electronic packages. The electronic packages may serve a variety of functions, such as a Bluetooth device, noise cancellation device that allows the user to focus on sounds of interest, a health-awareness monitoring a long with safety awareness monitoring, a fitness device, and/or any other suitable applications, where embodiments of the technology can include, communicate with, be integrated with, and/or can be otherwise associated with external accessories devices, such as devices including sensors, electronic configuration, and/or other suitable components for integration with, being configured for, and/or otherwise operating with components of the system, which can include one or more wireless in-ear utility devices.

The system (e.g., one or more Tri-Ear Buds, one or more in-ear utility devices, one or more remote computing systems, and/or other suitable components described herein, etc.) and/or portions of the system can entirely or partially be executed by, hosted on, communicate with, and/or otherwise include: one or more Tri-Ear Buds, in-ear utility devices, a remote computing system (e.g., a server, at least one networked computing system, stateless, stateful; etc.), a local computing system, a user device, databases (e.g., storing user audio profiles, storing user preferences, etc.), and/or any suitable component. Communication by and/or between any components of the system can include wireless communication (e.g., WiFi, Bluetooth, radiofrequency, etc.), wired communication, and/or any other suitable types of communication.

The components of the system can be physically and/or logically integrated in any manner (e.g., with any suitable distributions of functionality across the components, such as in relation to portions of the method; etc.). In variations, components of the system 200 can be positioned at (e.g., mounted at, integrated with, located proximal, etc.) any suitable location (e.g., relative an ear canal; relative another ear region of a user; relative another body region of the user; relative an in-ear utility device; relative other components of the system; etc.). Additionally or alternatively, components of the system can be integrated with any suitable existing components (e.g., databases, user devices, other audiology devices, etc.). However, the system and method can be configured in any suitable manner.

FIG. 01 illustrates an example of a wireless in-ear utility device 102 including a solid device, and a Tri-Ear Buds 101, according to an embodiment of the technology. In an example, the Tri-Ear Buds 101 is shown separated from the solid device, but in an example of operation, the Tri-Ear Buds 101 can fit over (and/or otherwise connect to) an in-ear main trunk support 105 extending from the solid device, wireless in-ear utility device 102, according to an embodiment of the technology. Tri-Ear Buds can also be known as "seals tips" or "Domes."

The Tri-Ear Buds 101 can function to optimize the quality of the acoustic sound performance and to provide the user's ear with improved breathability for improved in-ear health, according to an embodiment of the technology. Additionally or alternatively, the Tri-Ear Buds and/or other components of the system can confer any suitable benefits.

The Tri-Ear Buds 101 can include a special frequency filter portion residing on the perimeter of the Tri-Ear Buds 101 (e.g., when the wireless in-ear utility device 102 is in operation, etc.), but the Tri-Ear Buds can include any suitable frequency filters (e.g., filtering for any suitable frequency ranges) positioned at any suitable location relative other components of the Tri-Ear Buds 101. In examples, the Tri-Ear Buds 101 can include four support struts 104*a*, 104*b*, 104*c* and 104*d* designed to provide engagement at the entrance of the ear canal portion of the user's ear.

In examples, when the wireless in-ear utility device 102 is inserted into the user's ear during operation, the Tri-Ear Buds 101 can rest inside the user's ear canal, and sounds may be played from the speaker chamber 108 to the user via a speaker chamber port 204, which in examples, represents the part of the wireless in-ear utility device 102 residing furthest from the user's ear drum, which can allow for improved performance for output sound quality without being distorted.

In embodiments, the wireless in-ear utility device 102 does not touch the user's ear canal at any point during operation, and where the Tri-Ear Buds 101 can be compressed at 10% to 15% (and/or other suitable compression amount) in the ear canal of the user, which can allow for retention of the utility device for preventing the utility device from falling out of the user's ears. In examples, the Tri-Ear Buds 101 does not cover portions of the in-ear utility device outside of the user's ear canal, according to an embodiment of the technology.

In embodiments, the Tri-Ear Buds 101 is designed to configure and mimic the inner regions of the Ear canal, allowing for improved comfort between the wireless in-ear utility device 102 and the ear canal, according to an embodiment of the technology. In examples, these channels can lower pressure in the ear canal. Additionally or alternatively, the channels can serve the purpose of allowing ambient sounds at low frequency from 50 Hz to 300 Hz to pass through to the user's eardrum, but the channels can be adapted to any suitable frequency ranges. Thus, in examples, a user wearing the in-ear utility device 102 may continue to experience ambient sounds in a natural manner (e.g., low constant frequencies sound), and to experience the user's own voice to sound more natural to him/her, which can confer improvements over conventional ear bud devices and/or other suitable devices. Additionally or alternatively, in variations, the solid device 102 will not touch areas of the ear canal, which can increase user comfort and provide better in ear breathability and comfort, allowing the in-ear utility device 102 to be worn for extended periods of time, according to an embodiment of the technology.

In variations, the Tri-Ear Buds 101 allow the portion of the solid device body 102 that rests in the user's ear canal (e.g., the in-ear main trunk support 105) to reside safely in the ear canal. In examples, the solid device body 102 can include electrical components that do not typically touch the user's ear canal. The presence of the Tri-Ear Buds 101 can protect the user against potential malfunctions of an in-ear wireless device and/or other suitable devices. For example, if a device develops a short or extreme heat, the user can be protected due to the presence of the Tri-Ear Buds 101. Additionally or alternatively, in examples, the user can be protected by the Tri-Ear Buds 101 due to construction with bio-compatible materials and a design to be an insulator to protect the user's in-ear canal from harm. However, any suitable benefits and functionality can be conferred from the interaction between Tri-Ear Buds 101 and in-ear utility devices 102, and/or from the design of the Tri-Ear Buds 101.

The distance of the in-ear utility device 102 can vary based on the depth of the user's ear canal. Some user's have shallow ear canals while other users have deep ear canals. Therefore, the in-ear utility device 102, the Tri-Ear Buds 101 and/or other suitable components can be designed to keep a distance of the in-ear utility device 102 (e.g., a predetermined threshold distance) to keep a particular depth from the user eardrum.

In variations, the distal end (e.g., the outer end of the solid device 101 of the in-ear utility device 102) resides just outside the user's ear so that the in-ear utility device 102 may be easily removed by hand, according to an embodiment of the technology. In some embodiments of the technology, the in-ear utility device 102 might reside inside the ear canal with no part of the device outside the ear, but such an embodiment would still be inserted into the ear canal as for the Tri-Ear Buds and easily removed by a hand. However, the distal end and/or other suitable portions of the in-ear utility device 102 and/or Tri-Ear Buds 101 can reside at any suitable location relative other components, relative one or more ear regions, and/or can be positioned at any suitable location.

The wireless in-ear utility device can include a speaker chamber 108, according to an embodiment of the technology. In some embodiments, the speaker chamber 108 will not contact the eardrum and will not need any assistance of an audiologist. In some embodiments of the technology, the in-ear utility device may reside in a broader range to the user's eardrum (e.g., 1 mm. to 30 mm away; etc.). Additionally or alternatively, the in-ear utility device can reside at a location that provides improved sound quality to the user while also residing at a distance that does not require the employment of an audiologist to satisfy health and safety regulations. However, the speaker chamber 108 and/or other suitable components can be positioned at any suitable location.

In embodiments, the speaker chamber 108 can include a size greater than speaker chambers conventionally included in Bluetooth devices and/or other suitable devices. In examples, larger speaker chambers 108 in combination with a smaller form factor in-ear utility device 102 can result in positioning during operation where components rest into the user's Concha bowl of the user's ear more so than a conventional Bluetooth device and/or other suitable devices. However, the speaker chamber 108 can be of any suitable size.

In variations, an electronic component package can be fixed inside, mounted on, and/or embedded in or on the solid device body 101 of the in-ear utility device 102, according to an embodiment of the technology. This electronic component package can include components such as the speaker chamber 108, according to an embodiment of the technology. In embodiments, the size of the electronic component package can be selected based on the size and/or other characteristics of the Tri-Ear Buds (e.g., selecting a reduced size of the electronic component package to accommodate the size of the Tri-Ear Buds, etc.). Thus, in examples, the specific components in the electronic component package can be selected and/or packaged into a smaller form factor size, in addition to other characteristics, which can prevent harmonic distortion and/or feedback noise between the Mic and Speaker chamber, which can be designed to be isolated from each other, according to an embodiment of the technology. However, components described herein can include any suitable relative sizes.

In examples, the Tri-Ear Buds can conform without distortion when the in-ear utility device 102 is inserted into a user's ear canal without damaging the in-ear utility device 102 or causing harm to the user's ear. In examples, the conformability to the user's ear canal Tri-Ear Buds can cushion the user's ear canal from 102 causing any discomfort.

The Tri-Ear Buds can be adapted to improve comfort for the user in order for the user to be able to wear the in-ear utility device 102 for long periods of time. In variations, the Tri-Ear Buds can be designed so that they can compress 10% to 15% (and/or other suitable compression amount) into the user's ear canal without buckling or deforming, which can improve user comfort. Tri-Ear Bud materials (e.g., biocompatible materials silicone materials, etc.) can additionally or alternatively improve user comfort.

Human ear canals can have an oval shape. Embodiments of the Tri-Ear Buds 101 can be constructed at any suitable size, such as for covering a wide range of oval ear canal sizes. Thus, in examples, the Tri-Ear Buds 101 can be constructed in a variety of sizes (e.g., by varying size, dimensions, weight, and/or other suitable parameters of any suitable components of the Tri-Ear Buds, such as while maintaining the solid device body 102 to be manufactured in a single size, etc.), according to an embodiment of the technology. For example, the Tri-Ear Buds 101 covering the trunk of the device 203 can account for variations in size of user's ear canals (e.g., extra small, small, medium, large and extra large). However, the Tri-Ear Buds 101 and/or any other suitable components thereof can be of any suitable size, form factor, dimensions, and weight.

The Tri-Ear Buds 101 can be fabricated from any suitable resilient polymeric materials, according to an embodiment of the technology. In variations, the Tri-Ear Buds can be constructed from resilient polymeric materials of medical grade purity material. In specific examples, the Tri-Ear Buds 101 (e.g., covering the in-ear utility device 102; etc.) is formed of a material that has a Shore A Durometer value between 20-30, which can allow the material to flow freely in the mold while fabricating the Tri-Ear Buds, such as to achieve flexibility (e.g., which can be controlled by the wall thickness; etc.), which can allow for in-ear comfort and the Tri-Ear buds to compress from 10% to 15% (and/or other suitable compression amount) with no discomfort and allowing for wireless in-ear utility device 102 to have continuous retention in the use's ears for extended periods of time, according to an embodiment of the technology. Additionally or alternatively, natural rubber, neoprene rubber, SBR rubber (styrene block copolymer compounds), silicone rubber, EPDM rubber, polybutadiene rubber, polyvinylchloride elastomers, polyurethane elastomers, ethylene vinyls, acetate elastomers, elastomers based on acrylic acid precursors and vinyhalide polymers can be used for construction of the Tri-Ear Buds 101. However, the Tri-Ear buds can be constructed with any combination of any suitable materials.

Any number of tasks may be performed on the in-ear utility device 102, according to an embodiment of the technology. The wireless in-ear utility device 102 and the solid device portion 101 may comprise a variety of in-ear devices, such as hearing aids and wearable devices. In a variation, the device electronics reside in the solid device and not in the Tri-Ear Buds 101, but the system can include any suitable distribution of components across the solid device and the Tri-Ear Buds 101. The wireless in-ear utility device 102 can include a wireless in-ear utility device 102 of the type described in U.S. patent application Ser. No. 15/950,110, entitled "In-Ear Wireless Device With Bone Conduction Mic Communication", filed 10 Apr. 2018, which is herein incorporated by reference in entirety.

Figure 2:
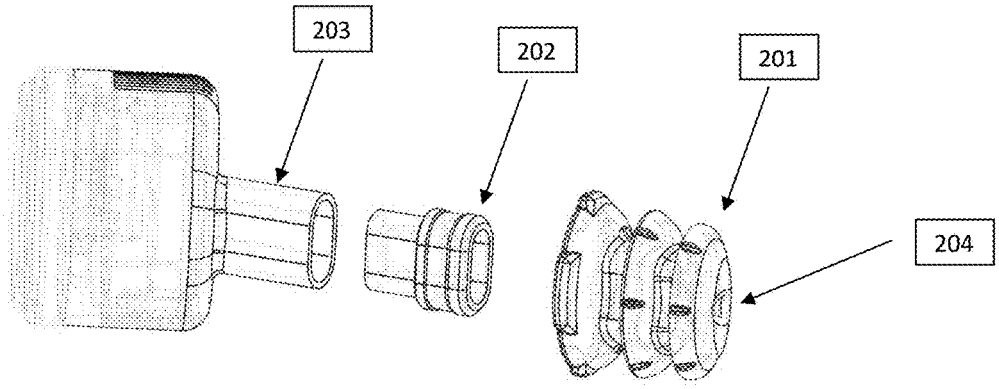
FIG. 02 illustrates an example of an embodiment of the technology in which a Tri-Ear Buds outer circumference of the Tri-Ear Buds 201 has been designed to accommodate an oval outer shape that mimics the ear canal that attaches to a wireless in-ear utility device 102, such as the in-ear main trunk support 203 shown on the solid device shown in FIG. 02, and where the insert horn 202 is designed to allow for the Tri-Ear buds to snap on and increase amplification, and where the insert horn is permanently attached to 203, according to an embodiment of the technology.

FIG. 02 illustrates an embodiment of the technology in which a Tri-Ear Buds cavity 405 of the Tri-Ear Buds 101 has been designed to accommodate an oval in-ear main trunk support from the solid device portion of a wireless in-ear utility device, such as the in-ear main trunk support 203 shown on the solid device portion 102 shown in FIG. 01, according to an embodiment of the technology. In examples, the Tri-Ear Buds cavity 203 has an oval shape that has been designed to accommodate the oval in-ear main trunk support 203 on the solid device portion 102, according to an embodiment of the technology, but the cavity can include any suitable shape. In examples, the solid portion 301 includes the in-ear main trunk support 203 that is surrounded by the Tri-Ear Buds cavity 405 when the Tri-Ear Buds 201 is attached to the solid portion 202.

Figure 3:
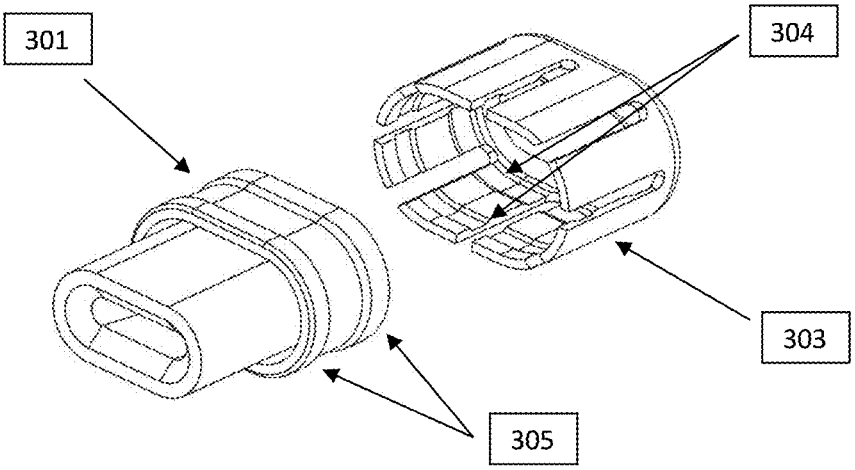
FIG. 03 illustrates an example of an embodiment of a horn utility device 301 which is inserted into a wireless in-ear utility device, where the Ratchet lock retainer for the Tri-Ear Buds 303 allows the Tri-Ear Buds 303 to snap on and off the solid ramp portion 305 and a groove portion in 304, according to an embodiment of the technology.

In examples, the Tri-Ear Buds cavity 405 facilitates placing a wireless in-ear utility device into small ear canals, but can be designed to accommodate any suitable ear canal size. In variations, a Ratchet lock retainer bonded to the Tri-Ear Buds 101 allows the Tri-Ear Buds 101 to snap on and off the device housing (e.g., the solid device 202 shown in FIG. 02, etc.). An embodiment of the Ratchet lock retainer 303 is shown in FIG. 03.

Additionally or alternatively, the Tri-Ear Buds cavity 405 could be designed to have other shapes, such as an oval shape, which can improve user comfort. However, the Tri-Ear Buds cavity 405 can include any suitable shape (e.g., a rectangular or round opening).

FIG. 02 illustrates an example of a wireless in-ear utility device 203 in which a Ratchet lock retainer 303 (e.g., ratchet ear bud lock, etc.) for the Tri-Ear Buds 201 allows the Tri-Ear Buds 201 to snap on and off the solid device portion 202, according to an embodiment of the technology. As shown in FIG. 02, in an example, the plastic Ratchet 202 fits into a cavity 203. In an example, the Ratchet lock retainer 303 can be bonded to the Tri-Ear Buds 201 using only medical grade epoxy, according to an embodiment of the technology.

The Ratchet lock retainer 303 outer wall can fit securely within a cavity in the Tri-Ear Buds 201 and fits or snaps securely onto device main trunk support section 203 of the solid device portion 202, according to an embodiment of the technology.

Figure 4:
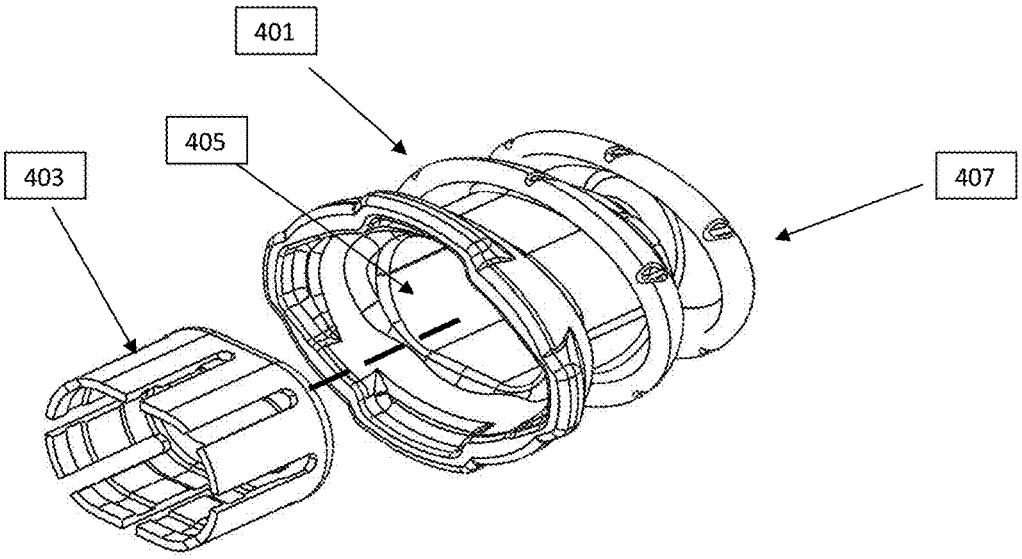
FIG. 04 illustrates an example of an embodiment of a Ratchet lock retainer 403 being inserted into an oval cavity 405 on a Tri-Ear Buds 401, according to an embodiment of the technology.

FIG. 04 illustrates a Ratchet lock retainer 403 being inserted into an oval cavity 405 on a Tri-Ear Buds 401 (e.g., where the Ratchet lock retainer 403, and/or other suitable components, such as a housing including a horn boost, can be oval shaped and/or other suitable shapes, etc.), according to an embodiment of the technology. The Ratchet lock retainer 403 is preferably inserted into the oval cavity 405 up to the distal end 407 of the Ratchet lock retainer 403. In other words, the Ratchet lock retainer 403 can be essentially buried within the Tri-Ear Buds 401, according to an embodiment of the technology. Additionally or alternatively, the Ratchet lock retainer 403 can be located at any suitable location (e.g., relative the Tri-Ear Buds 401, etc.).

Figure 5:
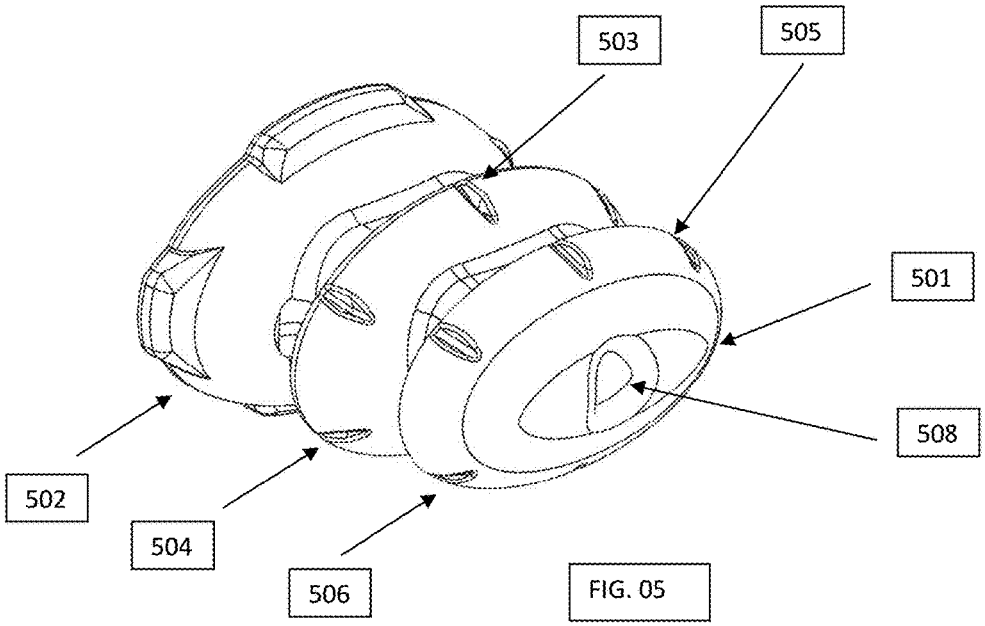
FIG. 05 illustrates an example of an embodiment of a Tri-Ear Buds 501 including twelve frequency filters 503, 505, where 6 are positioned on the middle seal tip and 6 are positioned on the outer seal tip 505, according to an embodiment of the technology.

FIG. 05 illustrates an embodiment of a Tri-Ear Buds 501 having six filter channels each 503, 505, according to an embodiment of the technology. In examples, the channels 503, 505 are fabricated into the Tri-Ear Buds 501 that resides closest to the user's ear canal during operation.

Examples of the Frequency Filter 503, 505 are shown in the closed position in FIG. 05. In examples, when the Frequency Filter 503, 505 allow leakage in the low frequency 50 Hz to 300 Hz, the Tri-Ear Buds 501 can attains its optimum acoustic sound performance. The user can receive the best acoustic performance from sounds emitted by a speaker chamber on the wireless in-ear utility device (e.g., the wireless in-ear utility device 102 shown in FIG. 1). Sounds from the wireless in-ear utility device can be emitted via the speaker chamber to port 508 on the Tri-Ear Buds 501, according to an embodiment of the technology. The speaker chamber port 508 can allow sounds from a speaker chamber on the solid device (e.g., the solid device 100 shown in FIG. 01) to be transmitted to the user's ear.

The Frequency Filter 503, 505 can additionally or alternatively be designed to prevent back pressure between the backend of the Tri-Ear Buds 501 and the user's ear drum cavity. Having the channels 503, 505 open and only allowing low frequency to pass through from 50 Hz and 300 Hz can protect the user's ear drum from sudden loud noises.

Thus, the Frequency Filter 503, 505 can relieve excessive pressure on all three tips 502,504 and 506 of the Tri-Ear Buds 501, which can help to prevent any harm to the user's eardrum.

Figure 6:
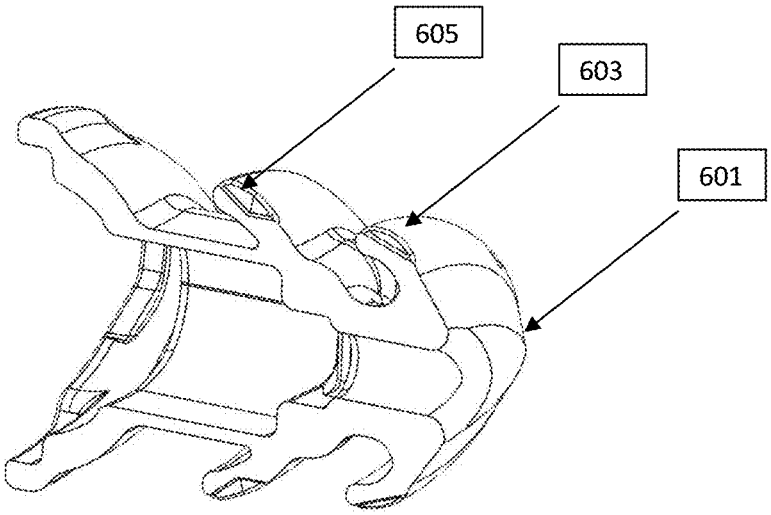
FIG. 06 illustrates an example of Frequency Filter 603, 605 of a Tri-Ear Buds 601 shown in a cut away image, according to an embodiment of the technology.

FIG. 06 illustrates Frequency Filter 603, 605 of a Tri-Ear Buds 601 shown in a cut away image, according to an embodiment of the technology. When the channels 603, 605, the Tri-Ear Buds 601 can attains its optimum acoustic sound performance.

The channels 603 and 605 can be designed to relieve buildup of back pressure between the backend of the Tri-Ear Buds 601 and the user's ear drum cavity. Opening the channels 603 can allow excess air to pass through to relieve pressure. The channels 605 can operates similarly to the channels 603, but can differ with directionality more focused into the ear canal and can allow air to pass through, due to the channel 605 being open. Having the channels 603, 605 open can protect the user's ear drum from sudden loud noises and sudden changes in pressure. However, the channels 603 and 605 can have any suitable openings for providing any suitable functionality in relation pass-through air, pressure, and other suitable aspects.

The channels 603, 605 can allow pressure to return to safe levels. Embodiments of the channels 603, 605 can additionally or alternatively include characteristics of channels further disclosed herein, including but not limited to.

Figure 7:
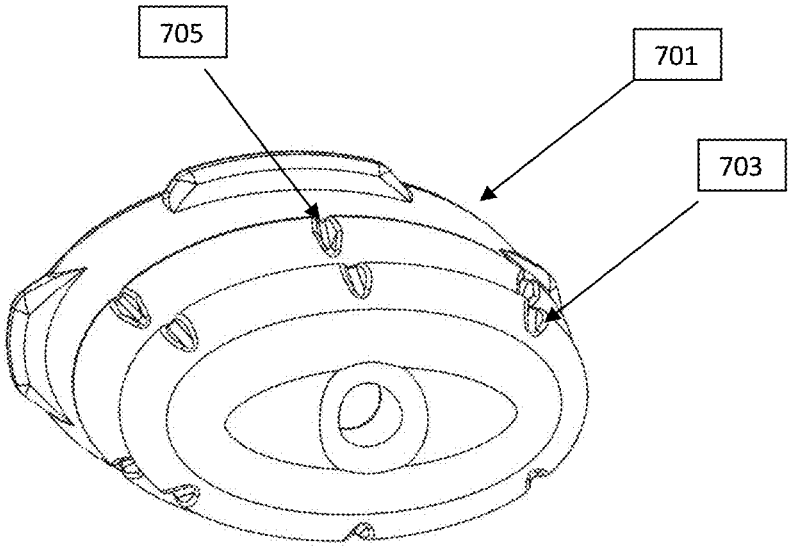
FIG. 07 illustrates an example of Frequency Filter 703, 705 shown from the backend of Tri-Ear Buds 701, according to an embodiment of the technology.

FIG. 07 illustrates examples of Frequency Filter 703, 705 shown from the backend of Tri-Ear Buds 701, according to an embodiment of the technology. As shown in FIG. 07 a channel 703 on a Tri-Ear Buds 701 is shown, according to an embodiment of the technology. Excessive pressure that may have built up by sound or a change in altitude can be relieved through the channels 703 and 705 into the atmosphere.

The Frequency Filter 703, 705 can be designed open to prevent pressure that could be excessive or approaching excess, according to an embodiment of the technology.

Once pressure has been relieved, the Frequency Filter 703, 705 can automatically facilitate optimal acoustic performance levels, according to an embodiment of the technology. As discussed herein, the Frequency Filter 703, 705 can include channels that are designed specifically to allow low frequencies from 50 Hz to 300 Hz to escape from the Tri-Ear Buds 701, acting as Frequency Filter 703, 705, according to an embodiment of the technology.

Figure 8:
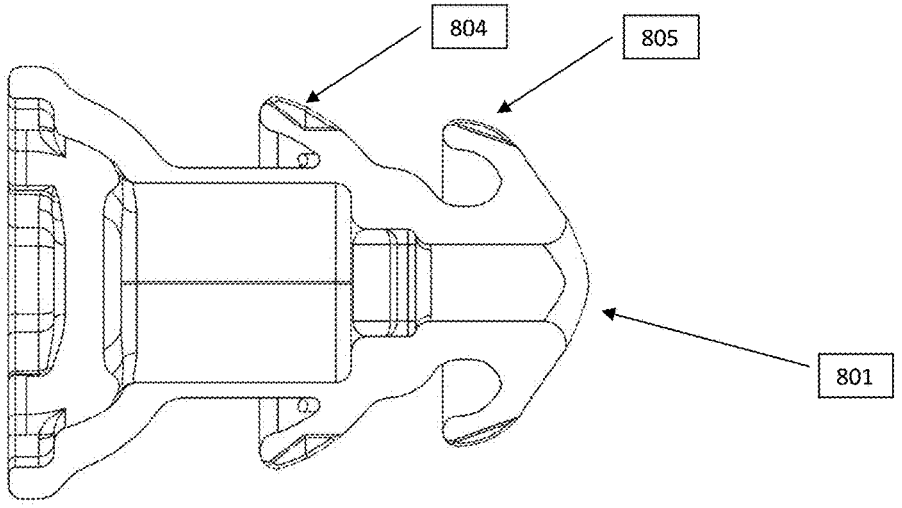
FIG. 08 illustrates an example of Frequency Filter 804 and 805 on Tri-Ear Buds 801 on the wireless in-ear utility device (e.g., the wireless in-ear utility device 101 shown in FIG. 01), where in the user's ear canal the channels are configured to direct the incoming and outgoing frequencies into the ear canal wall, therefore filtering out the low frequencies from the 50 Hz to 300 Hz, which can allow for better sound quality enhancement performance, according to an embodiment of the technology.

FIG. 08 illustrates examples of channels 804 and 805 on Tri-Ear Buds 801 that are always open as the wireless in-ear utility device (e.g., the wireless in-ear utility device 102 shown in FIG. 01) is being removed from the user's ear canal, which can prevent painful suction removal of the wireless in-ear utility device 102, according to an embodiment of the technology.

In variations, the channels 804 and 805 are always open when the wireless in-ear utility device (e.g., the wireless in-ear utility device 102 shown in FIG. 01) is removed from the user's ear canal to prevent any suction effect and discomfort or trauma to the user's ear drum.

The channels 804 and 805 can effectively prevent suction effect as the relative pressures on both sides begin to change as the wireless utility device is being removed from the user's ear canal. According to an embodiment of the technology, the channels 804, 805 are always open when the pressure differential on the Frequency Filter 804, 805 differs by approximately 0.125 PSI (but can additionally or alternatively be based on any suitable pressure differential, etc.). The pressure at which the Frequency Filter 804, 805 are open can be for preventing trauma to the eardrum, according to an embodiment of the technology.

Figure 9:
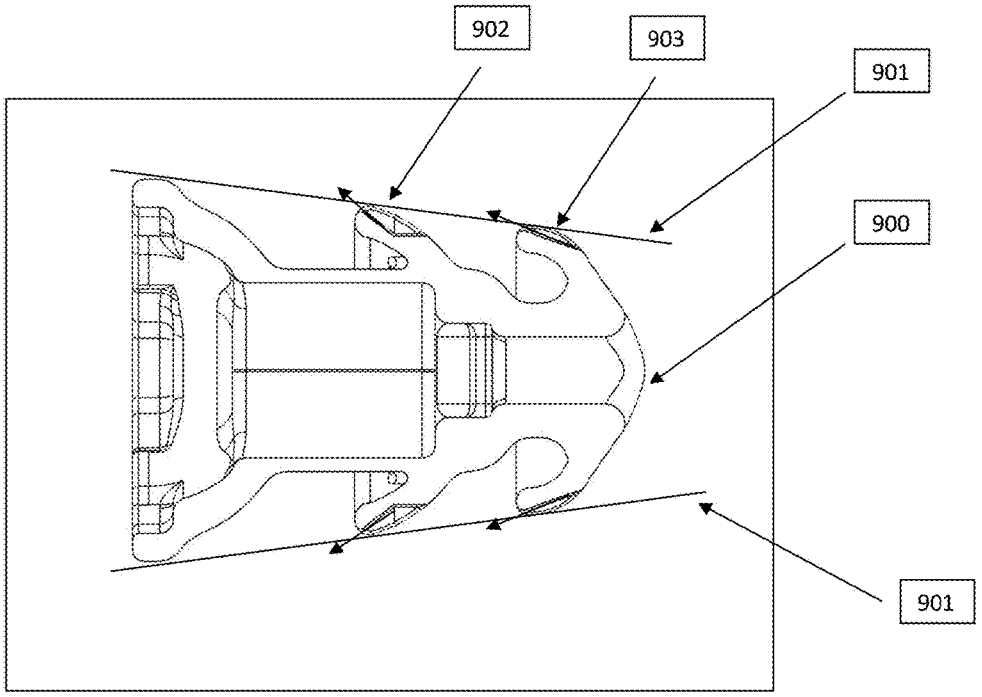
FIG. 09 illustrates a cutaway view of an example of Tri-Ear Buds 900 as 901 is the inner wall of the ear canal, where the wireless in-ear utility device 102 shown in FIG. 01) is not shown, where 902 and 903 channels are designed specifically to direct the frequency path into 901 the inner wall of the ear canal, assisting in filtering out the low frequencies, and where the channels length and width shown in FIG. 07 on 705 and 703 can aid in filtering out frequencies, according to an embodiment of the technology.

FIG. 09 illustrates examples of a cutaway view of channels 902 and 903 on Tri-Ear Buds 900 are open as the wireless in-ear utility device (e.g., the wireless in-ear utility device 102 shown in FIG. 01) is being removed from the user's ear canal, according to an embodiment of the technology.

Figure 10:
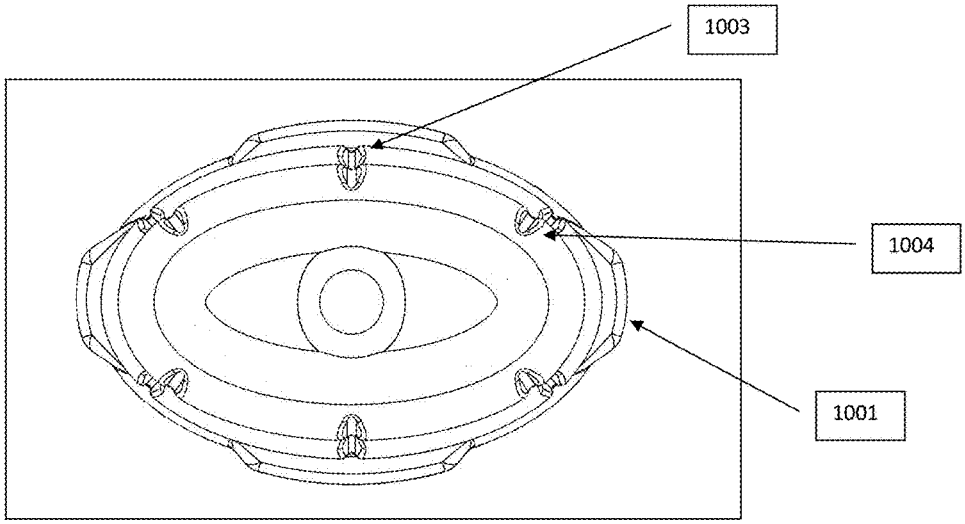
FIG. 10 illustrates an example of an inner channel 1004, and the mid channel 1003 on Tri-Ear Buds 1001 shown in a rear view 1004 and 1003, where the wireless in-ear utility device (e.g., the wireless in-ear utility device 102 shown in FIG. 01) is not being shown, according to an embodiment of the technology.
Figure 11:
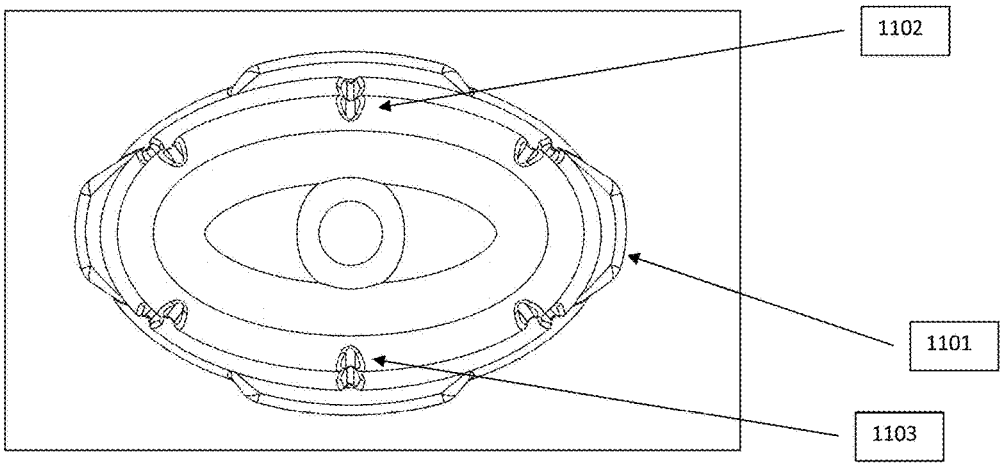
FIG. 11 illustrates an example of the channel openings allowing for in-ear breathability 1102, 1103 of a Tri-Ear Buds 1101, according to an embodiment of the technology.

FIG. 10 illustrates examples of channels 1003, 1004 on Tri-Ear Buds 1001 shown in a rear view of 1005 channels open as the wireless in-ear utility device (e.g., the wireless in-ear utility device 102 shown in FIG. 01) is removed from the user's ear canal, where the wireless in-ear utility device 102 is not shown, according to an embodiment of the technology.

In examples, the overall length of the Tri-Ear Buds 1101 channels 1102 and 1103 are approximately 0.125 inches, and the width of each channel is 0.030 inches and the depth is 0.030 inches, according to an embodiment of the technology. Additionally or alternatively, the channels 1102 and 1103 can have any suitable size, form factor, dimensions, and weight.

Figure 12:
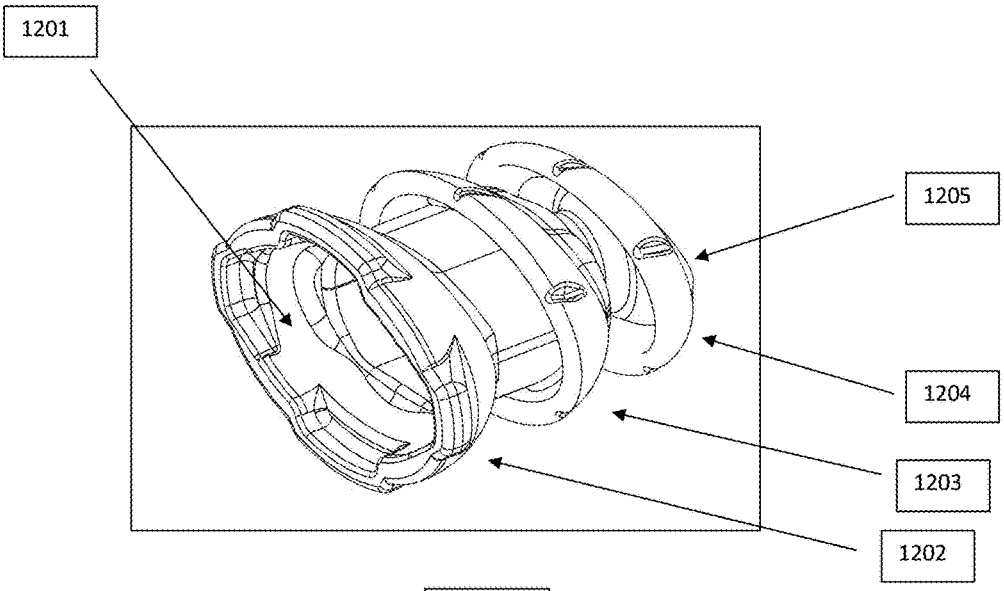
FIG. 12 illustrates an example where anyone of 1202 and 1203 can be bulged as long as there is one channel open in 1202 and 1203 for the breathability for the in-ear canal to maintain in good in-ear health (e.g., the channels openings 1102, 1103 shown in FIG. 11), according to an embodiment of the technology.

FIG. 12 illustrates an example of a bond comprised of three Tip portions 1202, 1203, 1204 and 1203 and 1204 including channels to a Tri-Ear Buds 1201 viewed from the portion of the Tri-Ear Buds 1205 that rests most closely to the user's tympanic membrane when the in-ear utility device is inserted into the user's ear, according to an embodiment of the technology.

The Tri-Ear Buds 101 and/or channels can be constructed with medical grade Bio-compatible silicone rubber (e.g., could last indefinitely), but can additionally or alternatively be replaced at predetermined time intervals (e.g., once a month, for improved ear health, etc.), and/or at any suitable time and frequency. However, the Tri-Ear Buds 101 and/or channels can be constructed with any suitable materials.

Figure 13:
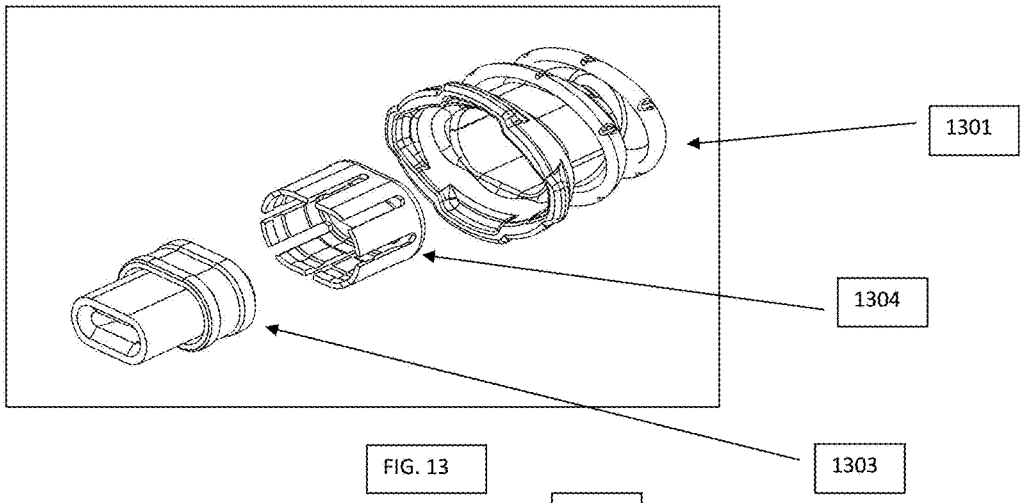
FIG. 13 illustrates an example comprised of three portions of the seal 1301, 1303, 1304 of the Tri-Ear Buds (e.g., the cavity 1201 shown in FIG. 12) to a Tri-Ear Buds 1301 the Tri-Ear Buds the portion of the rear of 1301 that rests most closely to the user's first bend within the ear canal when the in-ear utility device is inserted into the user's ear, according to an embodiment of the technology. In examples, the Tri-Ear Buds portion of the rear 1301 is 5 mm to 10 mm away from the first bend within the ear canal, and will maintain a sufficient distance from the eardrum to ensure that there will not be any damage to the user's eardrum.
Figure 14:
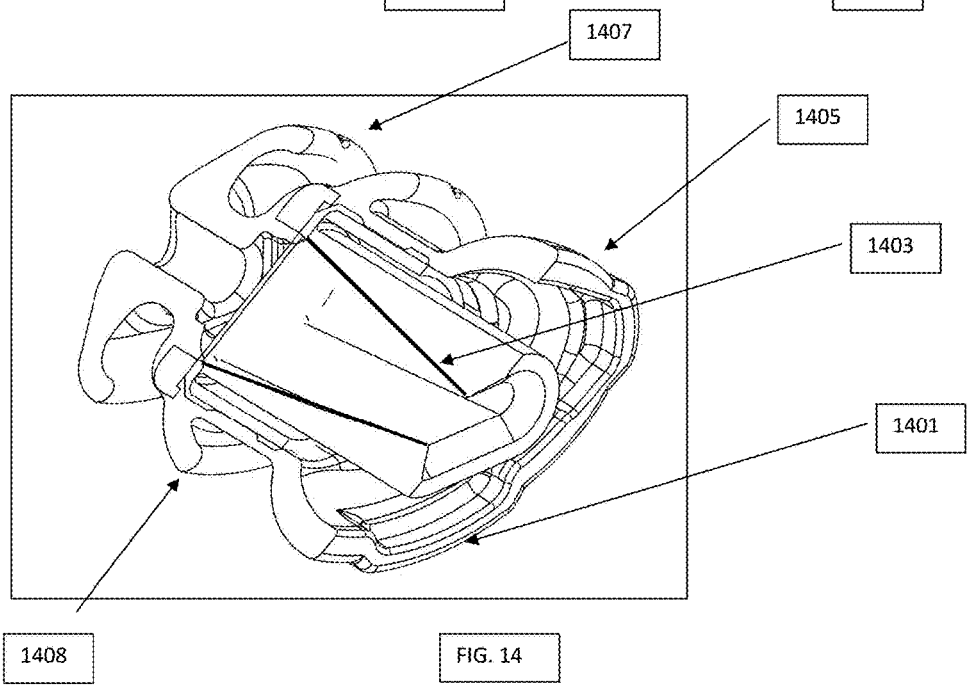
FIG. 14 illustrates an example of Tri-Ear Buds 1401 having a speaker chamber port 1403 that is designed to mimic an acoustic horn affect, according to an embodiment of the technology.
Figure 15:
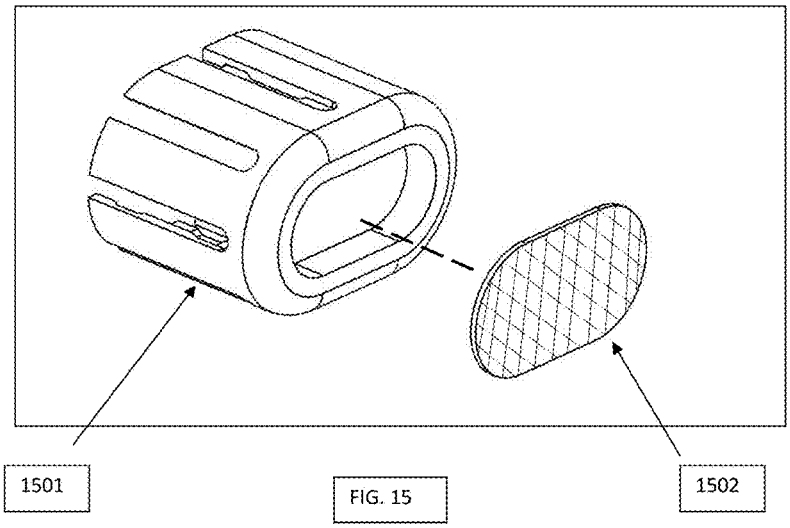
FIG. 15 illustrates an example of the membrane filter 1502 that prevents water and any foreign matter from penetrating into the wireless in-ear utility device 102 shown in FIG. 01 and 1502 is bonded onto 1501 shown in FIG. 16 as one embodiment 1602, according to an embodiment of the technology.
Figure 16:
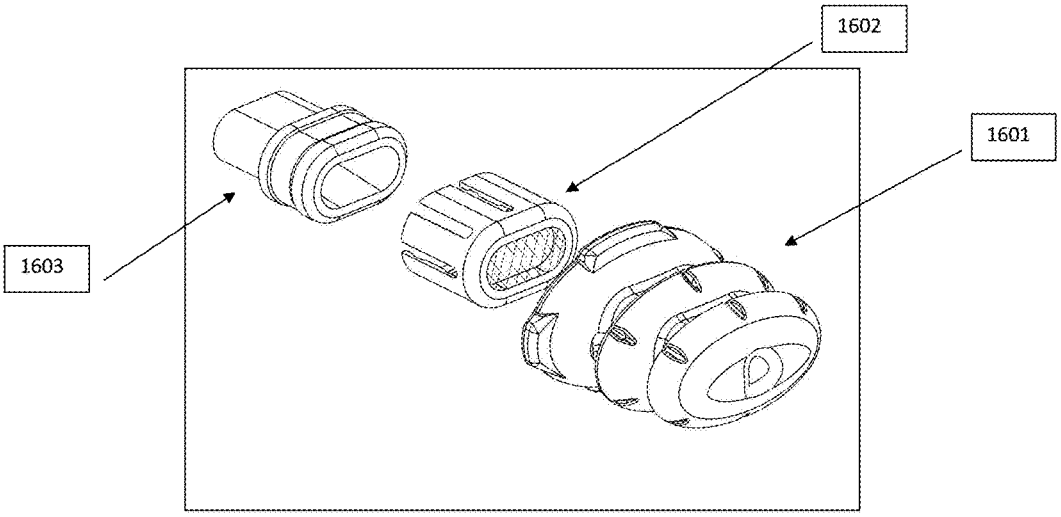
FIG. 16 illustrates an example of the membrane filter 1602 that can prevent water and any foreign matter from penetrating into the wireless in-ear utility device 102 shown in FIG. 01 and 1602 is bonded onto 1601 shown in FIG. 16 and, where an example illustrates that three components can be disposed of after one month, and a fresh one can be replaced for the wireless in-ear utility device 102 shown in FIG. 01, where the filter guard in a Tri-Ear Buds 1601 can facilitate improved user experience, and where the horn insert 1603 gets bonded to the wireless in-ear utility device 102 shown in FIG. 01 and 1602 snaps on and off of 1603, according to an embodiment of the technology.

FIG. 13 illustrates an example of Tri-Ear Buds 1301 designed to work with 1303 that is designed to mimic an acoustic horn effect, according to an embodiment of the technology. Applying the horn effect to the speaker chamber's output can increase the perceived output of sound from the speaker chamber by 5 dB to 10 dB, without having to increase the volume. Among other things, this application of the horn effect can reduce power consumption for the wireless in-ear utility device since the speaker chamber on the wireless in-ear utility device can provide greater sound to the user at lower power levels (e.g., in comparison with examples of a Tri-Ear Bud that does not provide an acoustic horn effect in combination, etc.). However, the system can include or omit the horn effect (e.g., components that generate the horn effect, etc.).

An acoustic horn or waveguide can include a tapered sound guide designed to provide an acoustic impedance match between a sound source and free air. This can have the effect of maximizing the efficiency with which sound waves from the particular source are transferred to the air. In examples, in the case of the Tri-Ear Buds 1401, the horn effect can be used to maximize the efficiency with which sound waves from the speaker chamber 1403 on a separate solid wireless in-ear utility device (e.g., the solid portion 102 of the wireless in-ear utility device 102 shown in FIG. 01) are transferred to the air of the ear canal and onto the user's tympanic membrane.

In examples, the horn effect can be improved if the three outer Tips of the Tri-Ear Buds 1403 incline slightly as they ascend from the outer ear portion of the Tri-Ear Buds to inner ear portion. In examples, the decreasing size of the three Tips can allow the Tri-Ear Buds 1401 to more easily navigate into the user's ear canal. Thus, ring 1405 can include a greater outer diameter than ring 1407, which itself can include a greater outer diameter than ring 1408, the innermost ring, according to an embodiment of the technology, but such components can have any suitable sizes (e.g., larger, same, or smaller relative each other, etc.).

In examples, the degree of inclination of the Tips 1405, 1407, and 1408 the Tri-Ear Buds 1401 in comparison inclined approximately 2 degrees step per tips starting from 1405, according to an embodiment of the technology, but can have any suitable degree of inclination and can be arranged at any suitable angle (and/or degree step) relative other components.

Various embodiments of the technology have been described in detail with reference to the accompanying drawings. References made to particular examples and implementations are for illustrative purposes, and are not intended to limit the scope of the technology or the claims.

It should be apparent to those skilled in the art that many more modifications of the in-ear utility device besides those already described are possible without departing from the inventive concepts herein. The inventive subject matter, therefore, is not to be restricted except by the scope of the appended claims. Moreover, in interpreting both the specification and the claims, all terms should be interpreted in the broadest possible manner consistent with the context.

Headings and sub-headings provided herein have been provided as assistance to the reader and are not meant to limit the scope of the technology disclosed herein. Headings and sub-headings are not intended to be the sole or exclusive location for the discussion of a particular topic.

While specific embodiments of the technology have been illustrated and described, it will be clear that the technology is not limited to these embodiments only. Embodiments of the technology discussed herein may have generally implied the use of materials from certain named equipment manufacturers; however, the technology may be adapted for use with equipment from other sources and manufacturers. Equipment used in conjunction with the technology may be configured to operate according to conventional protocols (e.g., Wi-Fi) and/or may be configured to operate according to specialized protocols. Numerous modifications, changes, variations, substitutions and equivalents will be apparent to those skilled in the art without departing from the spirit and scope of the technology as described in the claims. In general, in the following claims, the terms used should not be construed to limit the technology to the specific embodiments disclosed in the specification, but should be construed to include all syin-ear main trunk support s and methods that operate under the claims set forth herein below. Thus, it is intended that the technology covers the modifications and variations of this technology provided they come within the scope of the appended claims and their equivalents.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

As used herein, and unless the context dictates otherwise, the terms "ambient noise" and "ambient sound" have been used synonymously. Similarly, "sound" and "noise" have been used synonymous, except where the context shows a difference in meaning, e.g., "meaningful sound from mere noise."

The channel frequency filters can be calibrated and tuned in prior to shipping in high volume.

Although omitted for conciseness, the embodiments include every combination and permutation of the various system components and the various method processes, including any variations, examples, and specific examples, where the method processes can be performed in any suitable order, sequentially or concurrently using any suitable system components. Any of the variants described herein (e.g., embodiments, variations, examples, specific examples, illustrations, etc.) and/or any portion of the variants described herein can be additionally or alternatively combined, excluded, and/or otherwise applied.

The system and method and embodiments thereof can be embodied and/or implemented at least in part as a machine configured to receive a computer-readable medium storing computer-readable instructions. The instructions are preferably executed by computer-executable components preferably integrated with the system. The computer-readable medium can be stored on any suitable computer-readable media such as RAMs, ROMs, flash memory, EEPROMs, optical devices (CD or DVD), hard drives, floppy drives, or any suitable device. The computer-executable component is preferably a general or application specific processor, but any suitable dedicated hardware or hardware/firmware combination device can alternatively or additionally execute the instructions.

As a person skilled in the art will recognize from the previous detailed description and from the figures and claims, modifications and changes can be made to the embodiments without departing from the scope defined in the following claims.

We claim:

1. A system for improving use of an in-ear utility device, the system comprising:

Tri-Ear Buds adapted for a connection to an in-ear main trunk support extending from a solid portion of the in-ear utility device, wherein the Tri-Ear Buds are configured to reside in a user's ear canal within a first bend of the ear canal, wherein the Tri-Ear Buds comprise an end configured to reside in the user's ear canal at a distance less than 16 millimeters from the entrance of the user's ear canal;

a ratchet ear bud lock adapted to physically associate with the Tri-Ear Buds to facilitate the connection between the Tri-Ear Buds and the in-ear main trunk support, wherein the ratchet ear bud lock comprises locking features configured for a removal force adjustable from at least one of 0.25 Lbs/0.5 Lbs/0.75 Lbs/1.25 Lbs/1.5 Lbs/2.25 Lbs/2.5 Lbs, by way of decreasing jaws of the locking features; and a horn boost component adapted to physically associate with the in-ear utility device, and wherein the horn boost component is configured to facilitate an acoustic horn effect.

2. The system of claim 1, wherein the ratchet ear bud lock comprises at least two levels of engagement comprising a first engagement with force of the Tri-Ear Buds onto the in-ear utility devices, and a second engagement by applying consistent pressure until a detent is felt by a click feedback.

3. The system of claim 1, wherein the horn boost component is permanently attached to the in-ear utility device.

4. The system of claim 3, wherein the horn boost component is configured to increase sound output by at least 10 dB and to facilitate improved acoustic quality.

5. The system of claim 4, wherein the horn boost component is configured to improve battery life of the in-ear utility device by way of the at least 10 db sound output increase facilitated by the horn boost component.

6. The system of claim 3, wherein the horn boost component comprises a detent for allowing the ratchet ear bud lock to engage and lock onto.

7. The system of claim 1, wherein the Tri-Ear Buds comprise a micro-filter for preventing water and debris from entering a speaker port of the in-ear utility device.

8. The system of claim 1, wherein the Tri-Ear Buds comprise outer profile adapted to the ear canal and allowing for a uniform compression of 10% to 15% without buckling and distorting within the ear canal.

9. The system of claim 1, wherein the Tri-Ear Buds comprise micro channels configured to provide low frequency filtering in the range of 50 Hz to 300 Hz and assist in high quality sound performance output.

10. The system of claim 9, wherein the micro channels are configured to provide at least two levels of micro channel filtering of the frequencies, wherein the at least two levels facilitate the Tri-Ear Buds to filter in the range of 50 Hz to 300 Hz and assist in high quality sound performance output.

11. The system of claim 1, wherein the ratchet ear bud lock facilitates the connection between the Tri-Ear Buds and the in-ear main trunk support by enabling the Tri-Ear Buds to snap on and off at least one of the in-ear main trunk support and the solid portion.

12. The system of claim 1, wherein a size of the ratchet ear bud lock fits within a cavity of the Tri-Ear Buds.

13. The system of claim 1, wherein the Tri-Ear Buds comprise at least one component constructed with medical grade bio-compatible silicone rubber.

14. The system of claim 1, further comprising a wax guard physically attached to the Tri-Ear Buds.

15. The system of claim 14, wherein the wax guard comprises a disposable and replaceable wax guard, and wherein the wax guard is operable to improve ear health and audio output performance.

16. A system comprising:

a housing comprising an oval shaped Horn boost with a ratchet ear bud lock configured to reside in a user's ear canal within a first bend of the ear canal, wherein the Horn boost with the ratchet ear bud lock comprises a proximal end configured to reside in the user's ear canal at a distance less than 16 millimeters from the entrance of the user's ear canal, wherein the ratchet ear bud lock comprises locking features configured for a removal force adjustable from at least one of 0.25 Lbs/0.5 Lbs/0.75 Lbs/1.25 Lbs/1.5 Lbs/2.25 Lbs/2.5 Lbs, by way of decreasing jaws of the locking features, and wherein the ratchet ear bud lock is configured to facilitate a connection between the housing and Tri-Ear Buds.

17. The system of claim 16, further comprising the Tri-Ear Buds, wherein the Tri-Ear Buds comprise a low frequency filter allowing low frequency passage.

18. The system of claim 17, wherein the Tri-Ear Buds comprise an oval shape cavity adapted to physically connect with an oval shaped in-ear main trunk support of the housing, by way of the ratchet ear bud lock.

19. The system of claim 18, wherein a size of the ratchet ear bud lock fits within the oval shape cavity.

* * * * *